US005427571A

United States Patent [19]

Sells

[11] Patent Number: 5,427,571

[45] Date of Patent: Jun. 27, 1995

[54] VENTILATED CAP SYSTEM FOR THE RIDGE OF A ROOF

[75] Inventor: Gary L. Sells, Mishawaka, Ind.

[73] Assignee: Cor-A-Vent Incorporated, Mishawaka, Ind.

[21] Appl. No.: 287,186

[22] Filed: Aug. 8, 1994

[51] Int. Cl.[6] ..... F24F 7/02

[52] U.S. Cl. ..... 454/365; 52/57; 52/199

[58] Field of Search ..... 52/57, 199; 454/365, 454/366

[56] References Cited

U.S. PATENT DOCUMENTS 2,388,759 11/1945 Moore ..... 454/365
2,416,284 2/1947 Brown ..... 454/365 X
3,381,426 5/1968 Heidrich ..... 52/57 X
3,481,263 12/1969 Belden ..... 454/365
5,022,203 6/1991 Boyd ..... 454/365 X
5,352,154 10/1994 Rutter et al. ..... 454/365

*Primary Examiner*—Harold Joyce
*Attorney, Agent, or Firm*—Baker & Daniels

[57] ABSTRACT

A ventilated cap system for use on a ridge of a roof which includes an expandable utility cap to seal over a variably expanding metal roof. In one form a top cap may snap lock over the utility cap for slidable attachment thereto when exposed to deforming forces such as snow or ice. The top cap prevents deformation of the underlying utility cap. Roof panel clips permit uneven thermal expansion between metal panel members.

22 Claims, 6 Drawing Sheets

VENTILATED CAP SYSTEM FOR THE RIDGE OF A ROOF

BACKGROUND OF THE INVENTION

The invention relates to an improved ventilated cap for the ridge of a roof.

Prior ventilated roof caps have been fabricated from a corrugated material attached to the top edges of metal roofs. These ventilated caps include a high wind dome cap attached between venting members to seal the ridge opening formed between the opposite sides of the roof. As is known, metal roofs are widely used and have a tendency to expand and contract because of variations in temperatures. Due to present methods of attaching metal roofs to the roof purlin or roof trusses, such as tie downs on the base edges of the metal panels to the roof eave, these metal roofs expand from the bottom up. This type of expansion can cause uneven movement, noise, and wear of the high wind dome caps and associated venting closures.

An additional problem is that of environmental forces such as wind, ice or snow compressing the high wind dome cap to a point where water does not run off nor are the ridge openings adequately sealed. Additionally, the expansion of the metal roof may vary from panel to panel and from side to side along the roof thereby causing additional problems with the top cap ventilation system.

The present invention is directed to overcoming the aforementioned problems and others associated with prior ventilation cap assemblies.

SUMMARY OF THE INVENTION

The present invention overcomes the problems and disadvantages of the prior art by providing, in one form thereof, an outer top cap that snap locks and/or slides over the normal utility/weather cap thereby absorbing stresses from either environmental factors such as snow or ice or thermal expansion of the roof.

Generally, the invention provides a metal roof to which an elongate corrugated venting member is attached. A utility weather cap is attached over the venting member's and over the ridge of the roof to connect the opposite sides of the roof together and form a top apex. A top cap is slidably attached over the utility cap by engaging an extending edge of the utility cap. Installation ease is increased by a separate Z-shaped bracket disposed between the vent member and metal roof panel.

In another aspect of the invention, the utility cap includes one or more secondary folds to accommodate expansion of the roof. Additionally, a roof panel clip is disclosed for connecting adjacent metal panels together by slip fitting over upstanding edges of adjacent metal panels.

An advantage of the ventilated cap system of the present invention is that the system eliminates the problems associated with prior art vent cap systems by attaching a Z-shaped bracket to the metal roof thereby making installation easier.

Another advantage of the ventilated cap system of the present invention is that both environmental conditions and thermal expansion of the metal roof may be accommodated without destructive deformation of the cap system. The ridge or apex of the utility cap acts as a truss to prevent the top cap from being depressed and becoming unfastened at either of its edges that are slidably connected to the utility cap. The outer cap being depressed will not detach with a downward force but needs to be removed laterally from the utility cap.

Another advantage of the ventilated cap system of the present invention is that the inner utility cap includes an accordion structure such that water will not stand, but flow off at any degree of roof expansion.

Another advantage of the ventilated cap system of the present invention is that it simplifies and reduces the cost of installation of the system on metal roofs.

Yet another advantage of the ventilated cap system of the present invention is that the apex fold line and secondary fold lines of the utility cap reduce noise associated with the thermal movement of the metal roofs compared to the prior art.

The invention, in one form thereof, provides a ventilated cap system for a roof having opposed sides tapering upwardly to a ridge. The cap system includes a utility cap having an apex fold line and secondary fold lines parallel to the roof ridge. The utility cap is sealingly attached to a vent member having a plurality of corrugated layers of material defining a plurality of narrow elongated tubular vent openings transverse to the roof ridge. The vent member is connected to a side of the roof so that the utility cap apex fold line is oriented over the roof ridge while the utility cap is connected to the other side of the roof. The utility cap includes channels formed by the secondary fold lines whereby the channels reduce noise and permit movement for expansion between the sides of the roof.

The invention, in another form thereof, provides a ventilated cap system including a utility cap having an apex fold line parallel to the roof ridge and a vent member. The utility cap is sealingly attached to the vent member, connected to one side of the roof so that said utility cap .apex fold line is oriented over the ridge. The utility cap is connected to the other side of said roof, while having an edge extending away from the apex fold line and over one side of the roof. A top cap is attached to and locks over the utility cap by engaging its snap lock lip over the utility cap extending edge. The top cap is slidable relative to the extending edge whereby the top cap may compress under pressure.

The invention, in yet another form thereof, provides a ventilated cap system for a roof having opposed sides tapering upwardly to a ridge. The cap system includes a utility cap having an apex fold line parallel to the ridge and a pair of vent members attached to the utility cap. Each vent member is connected to an opposite side of the roof so that the utility cap apex fold line is oriented over the roof ridge with an edge extending over each side of the roof and away from the apex fold line. A top cap snap locks over the utility cap by engaging each extending edge and is slidable relative to each extending edge whereby the top cap may compress under pressure.

The invention, in still another form thereof, provides a ventilated roof and cap system including a metal roof having opposed sides tapering upwardly to a ridge, each side comprising a plurality of adjacent metal panels having a base and an upstanding edge. A roof panel clip is included for connecting adjacent metal panels together by slip fitting over the upstanding edges of adjacent metal panels. A utility cap having an apex fold line is sealingly attached to a pair of vent members. Each vent member is connected to an opposite side of the roof so that the utility cap apex fold line is oriented over the ridge. The utility cap includes an edge extending away from the apex fold line over each side of the roof so that a top cap may snap lock over the utility cap by engaging the extending edges. The top cap is slidable relative to each extending edge whereby the top cap may compress under pressure.

The invention, in still another form thereof, provides a metal roof having a first side and second side, the sides tapering upwardly to a ridge with each side comprising a plurality of adjacent metal panels, each panel having a base and an upstanding edge. A roof panel clip is utilized for connecting adjacent metal panels together by slip fitting over the upstanding edges of adjacent metal panels. Each roof panel clip comprises an outer member and inner member, with the inner member disposed within the outer member to form a biasing force between two of the upstanding edges when the roof panel clip is slip fit over adjacent upstanding edges.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
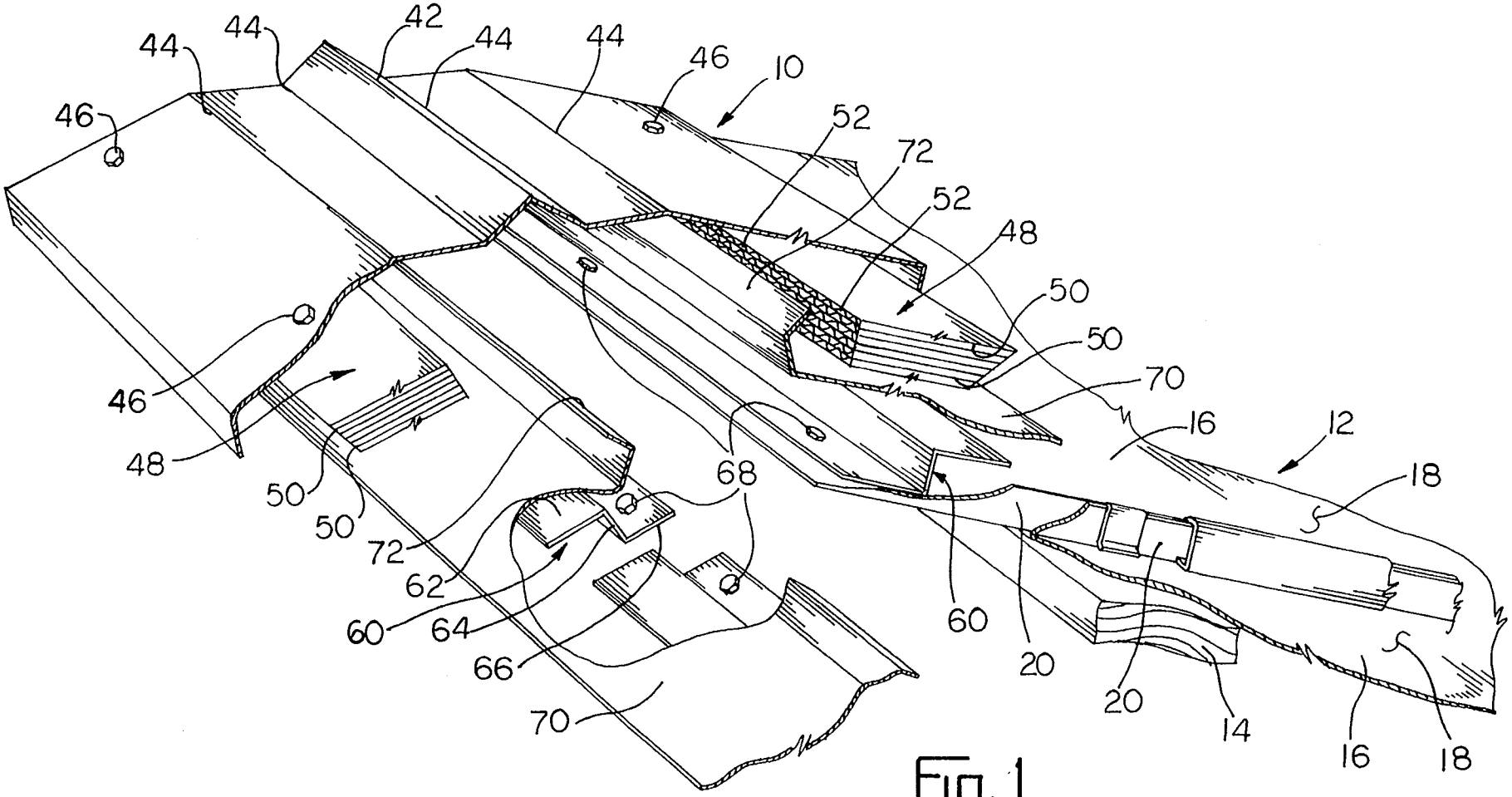
FIG. 1 is a fragmentary perspective view of a metal roof ventilation system of the type to which the present invention pertains.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Referring to the drawings, and particularly to FIG. 1, there is shown the ventilated cap system 10 of the present invention attached to a roof 12. Roof 12, as shown in FIG. 1, includes a horizontally extending purlin 14 to which is overlaid a plurality of metal panels 16. Each metal panel 16 includes a rectangular base portion 18 and at least one upstanding edge 20. Metal panels 16 overlay a typical roof having common rafters 22, as shown in FIGS. 3–6. As is known in the metal roof art, metal panels 16 are normally attached to roof 12 by tie-downs on the base edge of the roof eave. Adjacent panels 16 are attached by means of a roof panel clip 24 that slip fits over adjacent upstanding edges 20.

Figures 2, 7:
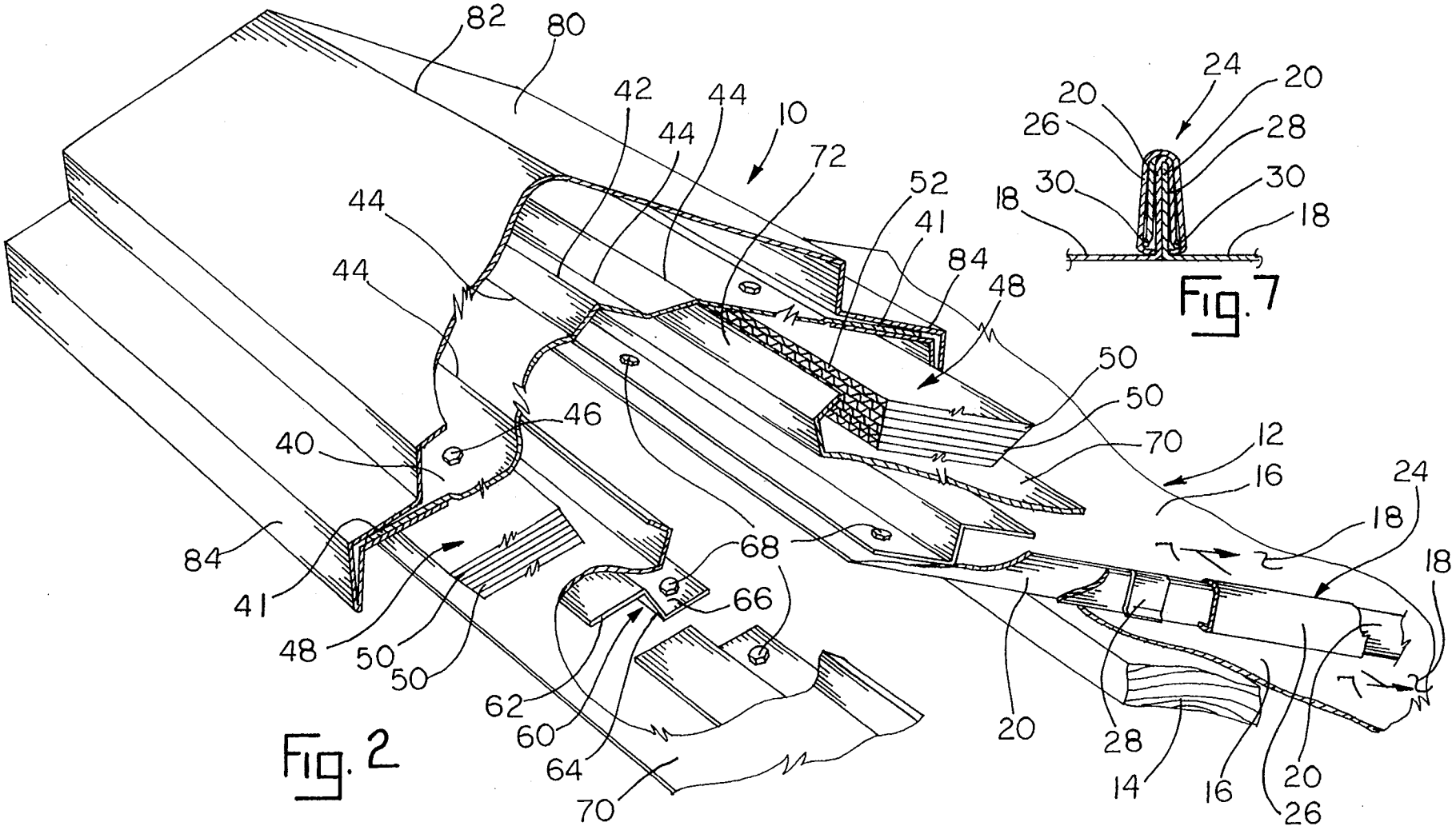
FIG. 2 is a fragmentary perspective view of an alternate embodiment of the present invention including an outer top cap.
FIG. 7 is a sectional view of the metal roof panel clip as shown in FIG. 2, taken along the line 7—7 and viewed in the direction of the arrows.

As shown in FIG. 7, a metal or plastic roof panel clip 24 includes an outer member 26 and an inner member 28 constructed in the form of a substantially C-shaped bracket. Inner member 28 includes outer edges 30 disposed within outer member 26 to create a biased force such that when adjacent edges 20 are slip fit into roof panel clip 24, the adjacent edges 20 are biased together to prevent separation. Roof panel clip 24 permits a slight lateral sliding motion between adjacent metal panels 16 thereby allowing for uneven thermal expansion or contraction due to environmental conditions on the roof. Roof panel clip 24 creates a water proof connection between adjacent panels 16.

Ventilated cap system 10 includes a specially shaped sheet metal utility cap 40 attached between opposite sides of roof 18 and over top roof ridge 13. Utility cap 40, sometimes known as a weather cap, includes an apex fold line 42 and a plurality of secondary fold lines 44. Utility cap 40 is attached to the opposite sides of roof 12 to thereby permit ventilation through and beneath roof 12 and common rafters 22. As shown more clearly in FIG. 3, utility cap 40 is attached by means of screws 46 to an elongate vent member 48 constructed from a plurality of corrugated layers 50 of material defining a plurality of narrow elongated tubular vent openings 52 transverse to ridge 13. A more detailed description of vent members 48 is found in U.S. Pat. No. 3,949,657 entitled "VENTILATION CAP FOR THE RIDGE OF THE ROOF", which is incorporated herein by reference.

As shown in FIGS. 3–6, fasteners, such as screws 46 pass through utility cap 40 through vent member 48 and into an elongate Z-shaped metal attachment bracket 60. Attachment bracket or closure 60 includes a top leg 62 attached to a middle portion 64 that extends to an oppositely oriented bottom leg 66. Bottom leg 66 is attached to a metal panel 16 by means of fasteners, such as screw 68. A roof 12 would typically have a plurality of Z-shaped attachment brackets 60 corresponding to each of the metal panels 16. Preferably, only one attachment bracket 60 is attached to each metal panel 16, thereby allowing different expansion rates on a particular metal panel 16 to be distributed through ventilated cap system 10. During assembly first Z-shaped bracket 60 is attached to roof 12 then vent member 48 and then utility cap 40.

As shown in FIGS. 1–6, a metal air dam flashing 70 may be disposed between vent members 48 and Z-shaped attachment bracket 60. Air dam 70 slows the possible ingress of wind and other matter due to an upstanding J-shaped portion 72 substantially covering the ridgeward side of vent member 48.

In an alternate embodiment of the present invention, utility cap 40 may have an extending edge 41 that extends away from apex fold 44 over one or both sides of roof 12. In this embodiment, an outside or top cap 80 is spring clipped over the extending edge 41 of utility cap 40. Top cap 80 may be dome shaped or A-shaped in cross section and constructed preferably from sheet metal.

Figure 5:
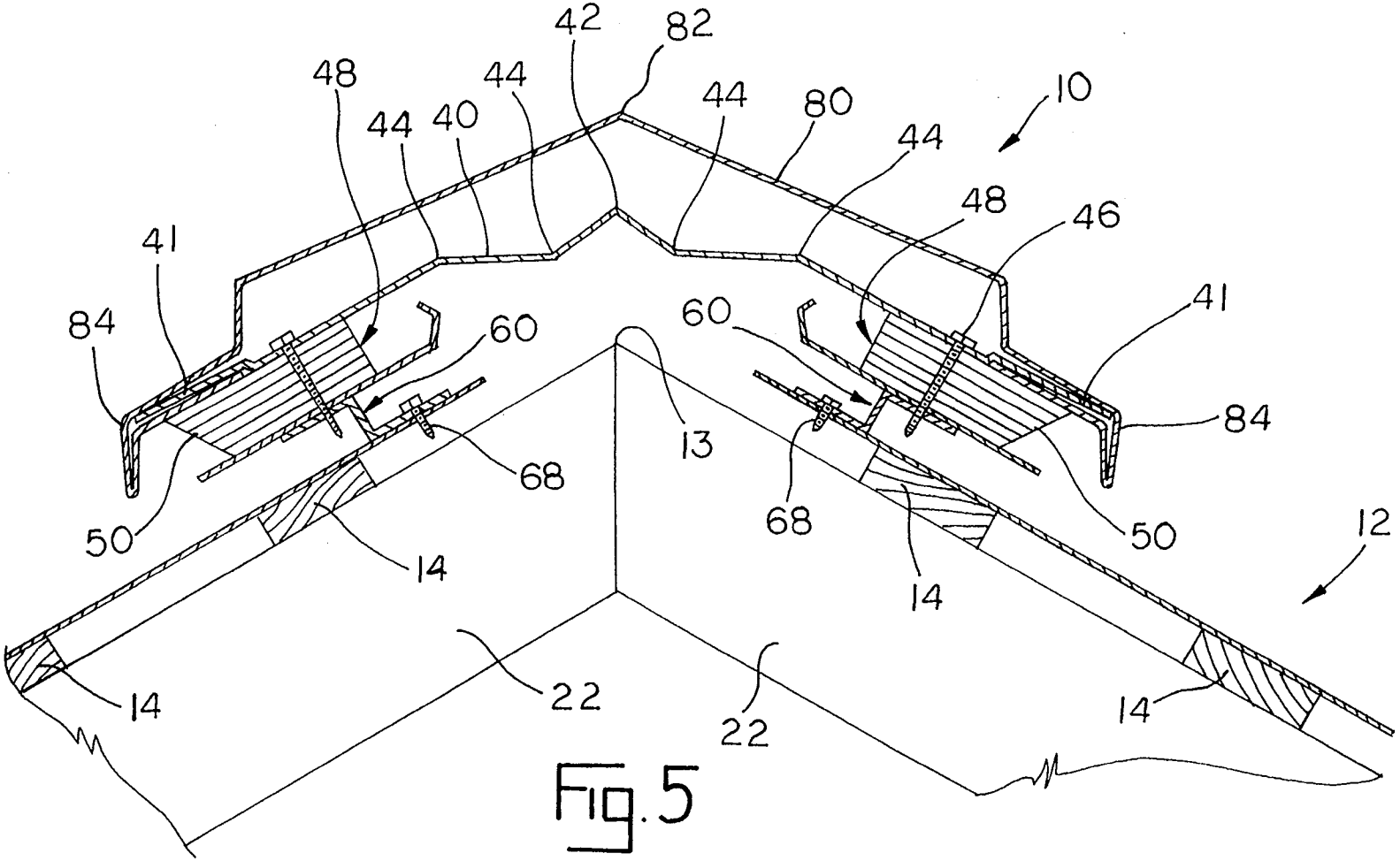
FIG. 5 is a sectional view of the alternate embodiment of the present invention shown in FIG. 2.

Top cap 80 as shown in FIG. 5 also includes an apex fold line 82. On the downward or lower edge of top cap 80 is an encircling or snap lock lip 84 that is able to engage over, around and under extending at 41 of utility cap 40. Snap lock lip 84 about encircling edge 41 creates a slidable attachment between top cap 80 and utility cap 40.

Figure 3:
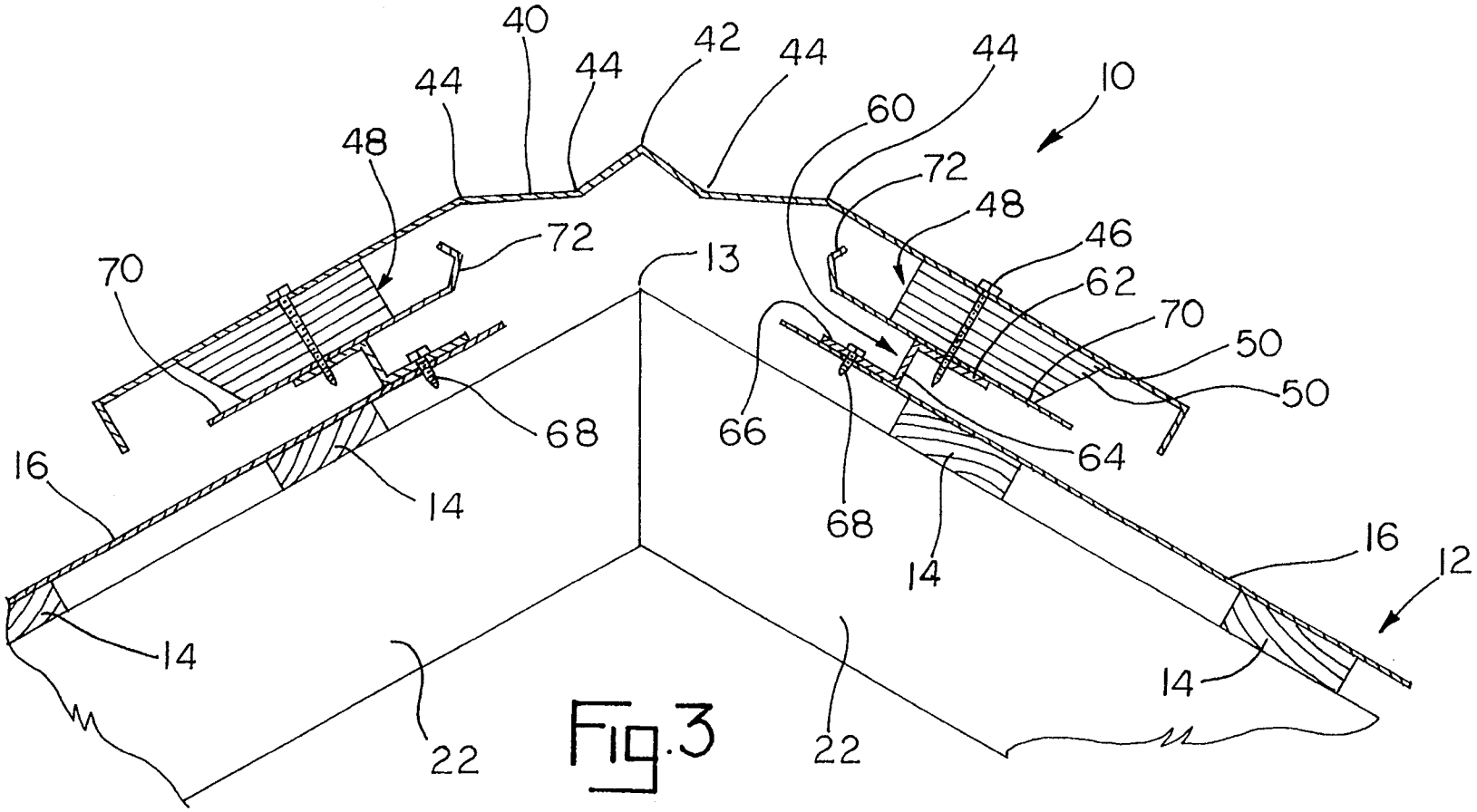
FIG. 3 is a sectional view of one form of the present invention.
Figure 4:
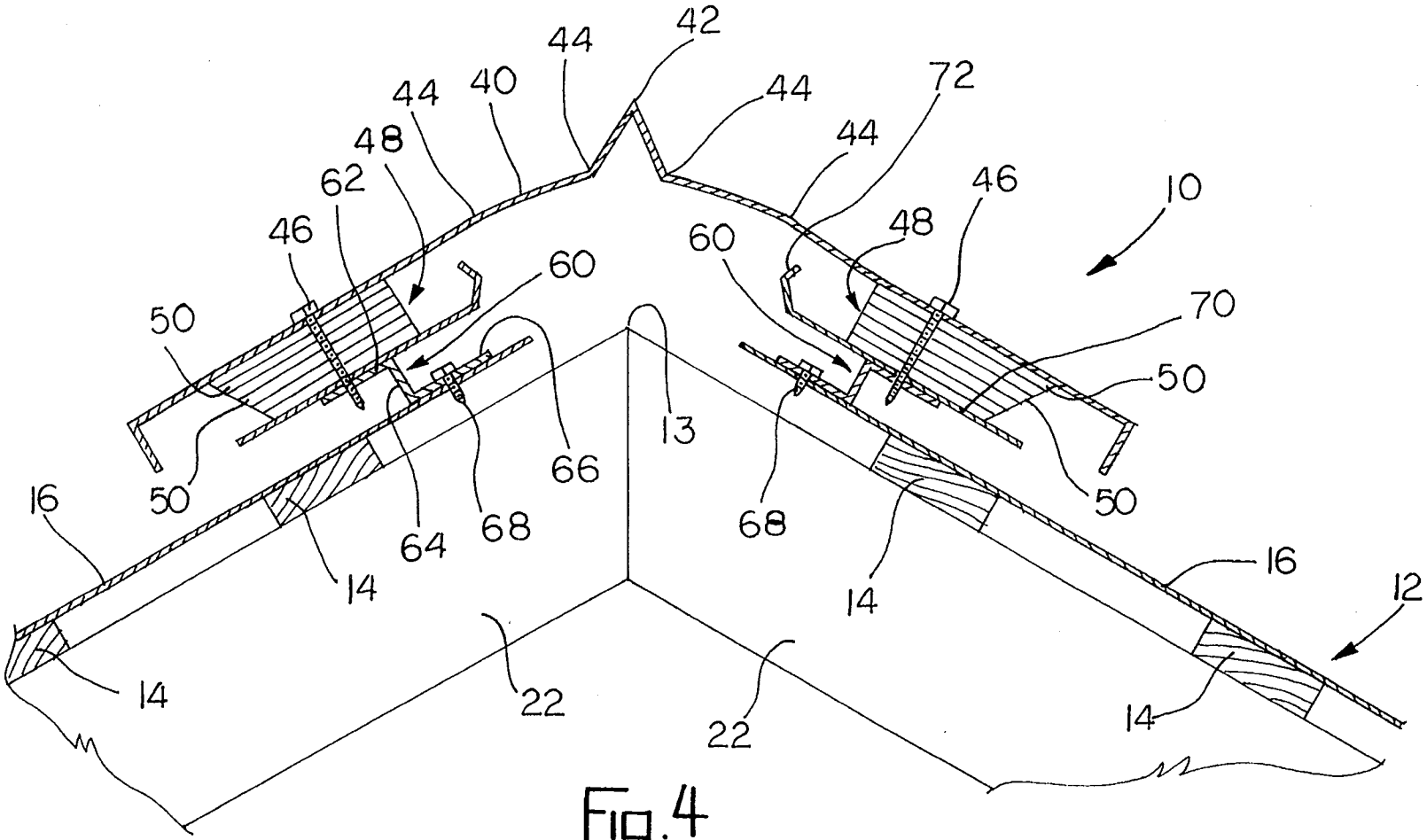
FIG. 4 is a sectional view of one form of the present invention with the metal roof in an expanded state.

In operation thermal stresses within roof 12 specifically expansion or contraction of the metal panel 16 due to temperature will cause panel 16 to slide either toward or away from ridge 13 since normally metal panel 16 will be attached to the roof eave (not shown). This expansion or contraction will cause utility cap 40 to bend along apex fold line 42 and secondary fold lines 44 thereby accommodating expansion of roof 12 as shown in FIG. 4. The expansion and contraction in accordion like fashion of utility cap 40 reduces the noise as compared to prior metal roof ventilation cap. Additionally, fold lines 42 and 44 creates channels therebetween to prevent water or other material from standing on utility cap 40. FIG. 3 shows ventilated cap system 10 in a state where the roof is not expanded while FIG. 4 shows ventilated cap system 10 with metal panel 16 expanded due to temperature and utility cap 40 bent along fold lines 42 and 44 accommodating expansion with a minimum of noise.

Figure 6:
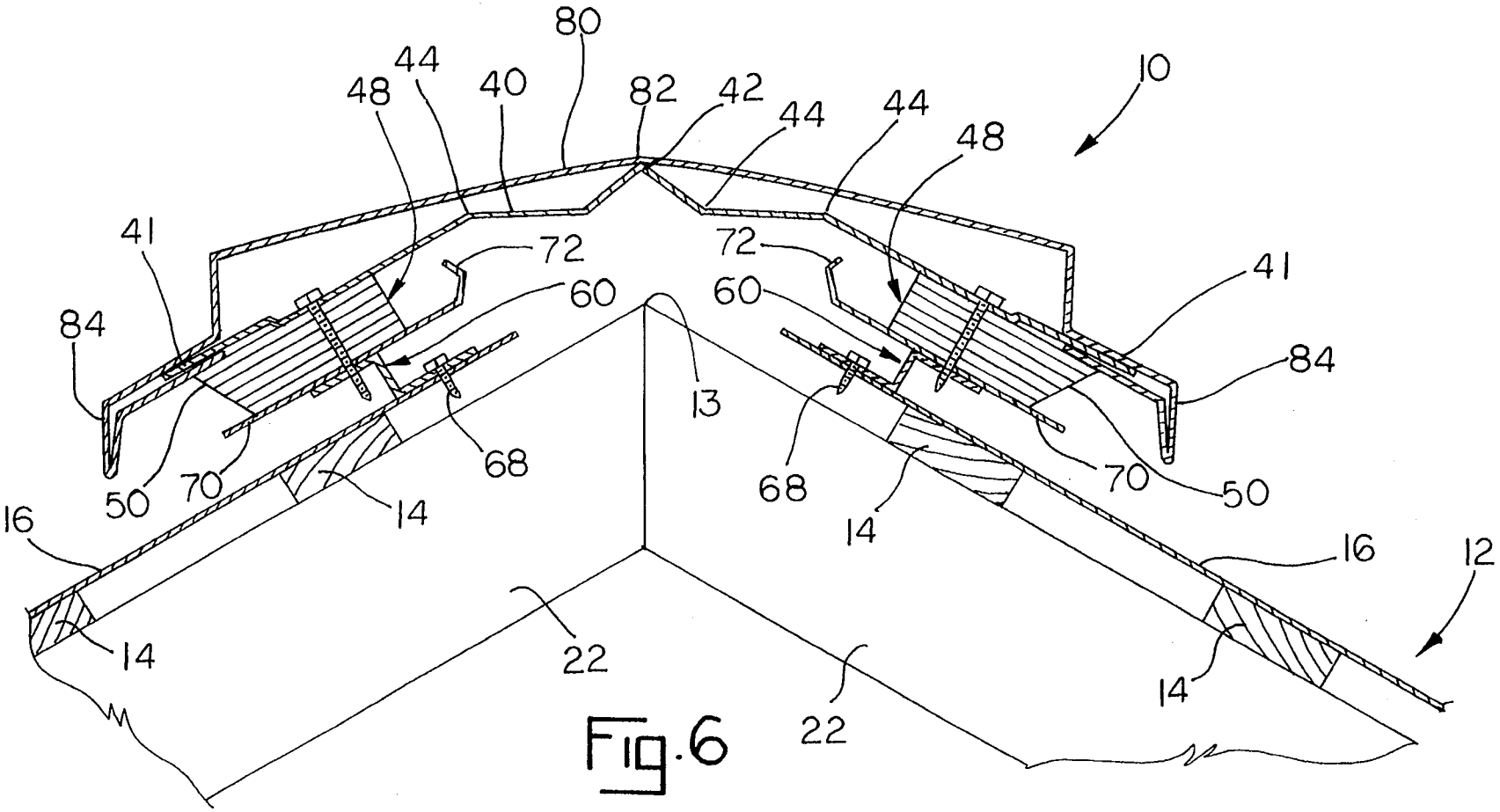
FIG. 6 is a sectional view of the alternate embodiment of the present invention with the metal roof in an expanded state.

The alternate embodiment of the invention is show in FIGS. 5 and 6 discloses a situation where a top cap 80 may be loaded with a force such as the weight of snow, ice or other matter which causes top cap 80 to flex at its apex fold line 82 causing snap lock lip 84 to slide away from extending edge 41 of utility cap 40. As shown in FIG. 6 top cap 80 has compressed to a degree to where the apex fold line 42 of utility cap 40 abuts or engages top cap 80. At this time apex fold line 42 acts as a truss or fulcrum support to prevent top cap 80 from being further depressed or becoming unfastened at either of its snap lock lips 84 from extending edge 41. Top cap 80 cannot be removed from utility cap 40 without a lateral force. As disclosed above, particular side and downward pressures on top cap 80 may be caused by wind, ice or snow. Top cap 80 creates an aesthetic visual impact for ventilation cap system 10 while enabling the system to handle larger pressures without failure. Specifically, top cap 80 will prevent utility cap 40 from becoming deformed. The structure as shown in FIG. 6 prevents snow weight problems that have deformed and caused failure to prior art ventilation caps.

While this invention has been described as having a preferred design, the present invention can be further modified within the spirit and scope of this disclosure.. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A ventilated cap system for a roof, the roof having opposed sides tapering upwardly to a ridge, said cap system comprising:

a utility cap having an apex fold line and secondary fold lines parallel to the ridge;

a vent member including a plurality of corrugated layers of material defining a plurality of narrow elongated tubular vent openings transverse to the ridge, said utility cap attached to said vent member, said vent member connected to a side of the roof so that said utility cap apex fold line is oriented over the ridge, said utility cap connected to the other side of the roof, said utility cap having channels formed by said secondary fold lines whereby said channels reduce noise and permit movement for expansion between said sides of said roof.

2. The ventilated cap system of claim 1 in which said utility cap is connected to the other side of said roof by a second vent member.

3. The ventilated cap system of claim 1 in which said vent member is connected to said side by an elongate Z-shaped bracket.

4. The ventilated cap system of claim 1 in which said utility cap includes an extending edge, said system further including a top cap snap locking over said utility cap extending edge whereby said top cap prevents said utility cap from being deformed.

5. The ventilated cap system of claim 1 in which said utility cap includes an extending edge, said system further including a top cap slidingly attaching over said extending edge whereby said top cap prevents said utility cap from being deformed.

6. The ventilated cap system of claim 5 in which said apex fold line of said utility cap prevents said top cap from disengaging said extending edge.

7. The ventilated cap system of claim 5 in which said top cap is A-shaped in cross section.

8. A ventilated cap system for a roof, the roof having opposed sides tapering upwardly to a ridge, said cap system comprising:

a utility cap having an apex fold line parallel to the ridge;

a vent member attached to said utility cap, said vent member connected to one side of the roof so that said utility cap apex fold line is oriented over the ridge, said utility cap connected to the other side of said roof, said utility cap having an edge extending away from said apex fold line over said one side of the roof; and a top cap snap locking over said utility cap by engaging said extending edge, said top cap slidable relative to said extending edge whereby said top cap may compress under pressure.

9. The ventilated cap system of claim 8 in which said apex fold line of said utility cap prevents said top cap from disengaging said extending edge.

10. The ventilated cap system of claim 8 in which said top cap is A-shaped in cross section.

11. The ventilated cap system of claim 8 in which said vent members are connected to each side by an elongate Z-shaped bracket.

12. The ventilated cap system of claim 8 in which said roof is formed of metal.

13. A ventilated cap system for a roof, the roof having opposed sides tapering upwardly to a ridge, said cap system comprising:

a utility cap having an apex fold line parallel to the ridge;

a pair of vent members, said utility cap attached to said vent members, each said vent member connected to an opposite side of the roof so that said utility cap apex fold line is oriented over the ridge, said utility cap having an edge extending away from said apex fold line over each side of the roof; and a top cap snap locking over said utility cap by engaging each extending edge, said top cap slidable relative to each extending edge whereby said top cap may compress under pressure.

14. The ventilated cap system of claim 13 in which said apex fold line of said utility cap prevents said top cap from disengaging said extending edges.

15. The ventilated cap system of claim 13 in which said top cap is A-shaped in cross section.

16. The ventilated cap system of claim 13 in which said vent members are connected to each side by an elongate Z-shaped bracket.

17. The ventilated cap system of claim 13 in which said roof is formed of metal.

18. A ventilated roof and cap system, said system comprising:

a metal roof having opposed sides tapering upwardly to a ridge, each said side comprising a plurality of adjacent metal panels, each panel having a base and an upstanding edge;

a roof panel clip for connecting adjacent metal panels together by slip fitting over said upstanding edges of adjacent metal panels;

a utility cap having an apex fold line parallel to the ridge;

a pair of vent members including a plurality of corrugated layers of material defining a plurality of narrow elongated tubular vent openings transverse to the ridge, said utility cap attached to said vent members, each said vent member connected to an opposite side of the roof so that said utility cap apex fold line is oriented over the ridge, said utility cap having an edge extending away from said apex fold line over each side of the roof; and a top cap snap locking over said utility cap by engaging each extending edge, said top cap slidable relative to each extending edge whereby said top cap may compress under pressure.

19. The ventilated roof and cap system of claim 18 in which said apex fold line of said utility cap prevents said top cap from disengaging said extending edges.

20. The ventilated roof and cap system of claim 18 in which said top cap is A-shaped in cross section.

21. The ventilated roof and cap system of claim 18 in which said vent members are connected to each side by an elongate Z-shaped bracket.

22. The ventilated roof and cap system of claim 18 in which roof panel clip comprises an outer member and inner member, said inner member disposed within said outer member to form a biasing force between two said upstanding edges when said roof panel clip is slip fit over said adjacent upstanding edges.

* * * * *